US008253679B2

(12) United States Patent
Kim et al.

(10) Patent No.: US 8,253,679 B2
(45) **Date of Patent: *Aug. 28, 2012**

(54) GATE DRIVE DEVICE WITH SHIFT REGISTER FOR DISPLAY DEVICE AND DISPLAY DEVICE HAVING THE SAME

(75) Inventors: Woo-Chul Kim, Yongin-si (KR); Jun-Pyo Lee, Seongnam-si (KR); Seung-Hwan Moon, Yongin-si (KR); Sun-Kyu Son, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 333 days.

This patent is subject to a terminal disclaimer.

(21) Appl. No.: 12/618,094

(22) Filed: Nov. 13, 2009

(65) Prior Publication Data

US 2010/0060619 A1 Mar. 11, 2010

Related U.S. Application Data

(63) Continuation of application No. 11/341,676, filed on Jan. 27, 2006, now Pat. No. 7,633,481.

(30) Foreign Application Priority Data

Apr. 11, 2005 (KR) ..... 10-2005-0029903

(51) Int. Cl.
*G09G 3/36* (2006.01)

(52) U.S. Cl. ..... 345/99

(58) Field of Classification Search ..... 345/87–100, 345/204

See application file for complete search history.

(56) References Cited

U.S. PATENT DOCUMENTS

| | | | | |
|---|---|---|---|---|
| 6,445,372 | B1 | 9/2002 | Asai | |
| 6,833,872 | B1 * | 12/2004 | Nakagawa | 348/311 |
| 7,042,426 | B2 * | 5/2006 | Shin | 345/76 |
| 7,256,759 | B2 * | 8/2007 | Kim et al. | 345/87 |
| 7,425,942 | B2 * | 9/2008 | Lee et al. | 345/99 |
| 7,633,481 | B2 * | 12/2009 | Kim et al. | 345/99 |
| 2002/0044127 | A1 | 4/2002 | Uchino et al. | |
| 2002/0140364 | A1 | 10/2002 | Inukai | |
| 2003/0038766 | A1 | 2/2003 | Lee et al. | |
| 2004/0085272 | A1 * | 5/2004 | Ting et al. | 345/87 |
| 2004/0189583 | A1 | 9/2004 | Park et al. | |

(Continued)

FOREIGN PATENT DOCUMENTS

CN 1209567 A 3/1999

(Continued)

*Primary Examiner* — Sumati Lefkowitz
*Assistant Examiner* — Rodney Amadiz
(74) *Attorney, Agent, or Firm* — Cantor Colburn LLP

(57) ABSTRACT

A gate drive portion for a display device including multiple pixels having first and second sub-pixels includes a first shift register generating a first output signal in response to a first gate clock signal, a second shift register generating a second output signal in response to a second gate clock signal, a level shifter coupled to the first and second shift registers and amplifying the first and second output signals, and an output buffer coupled to the level shifter and generating first and second gate signals. The first gate signal is generated in synchronization with the first gate clock signal and the second gate signal is generated in synchronization with the second gate clock signal. Accordingly, the charging time of the first and second sub-pixels may be improved by separately driving the odd-numbered and even-numbered sub-pixels and the visibility of the LCD device may also be improved.

23 Claims, 9 Drawing Sheets

U.S. PATENT DOCUMENTS

| | | | | |
|---|---|---|---|---|
| 2004/0217935 | A1 | 11/2004 | Jeon et al. | |
| 2004/0263448 | A1* | 12/2004 | Baek et al. | 345/87 |
| 2005/0231455 | A1* | 10/2005 | Moon | 345/89 |
| 2006/0284815 | A1 | 12/2006 | Kwon et al. | |

FOREIGN PATENT DOCUMENTS

| | | | |
|---|---|---|---|
| CN | 1480952 | A | 3/2004 |
| CN | 1534583 | | 10/2004 |
| CN | 1573878 | A | 2/2005 |
| JP | 62092588 | | 4/1987 |
| JP | 04322216 | | 11/1992 |
| JP | 05341734 | | 12/1993 |
| JP | 06075204 | | 3/1994 |
| JP | 06161380 | | 6/1994 |
| JP | 06281944 | | 10/1994 |
| JP | 08190366 | | 7/1996 |
| JP | 10096888 | | 4/1998 |
| JP | 11038943 | | 2/1999 |
| JP | 2000122622 | | 4/2000 |
| JP | 2000162577 | | 6/2000 |
| JP | 2000162982 | | 6/2000 |
| JP | 2000235371 | | 8/2000 |
| JP | 2001083941 | | 3/2001 |
| JP | 2003195819 | | 7/2003 |
| JP | 2003330430 | | 11/2003 |
| JP | 2004061552 | | 2/2004 |
| JP | 2004062146 | | 2/2004 |
| JP | 2005316211 | | 11/2005 |
| KR | 1019940009132 | | 10/1994 |
| KR | 100172874 | | 10/1998 |
| KR | 19990077075 | | 10/1999 |
| KR | 1020010007610 | A | 1/2001 |
| KR | 1020030080979 | A | 10/2003 |
| KR | 1020040038250 | | 5/2004 |
| KR | 1020040070537 | A | 8/2004 |
| KR | 1020050030284 | | 3/2005 |

* cited by examiner

400

GATE DRIVE DEVICE WITH SHIFT REGISTER FOR DISPLAY DEVICE AND DISPLAY DEVICE HAVING THE SAME

This is a continuation application of U.S. patent application Ser. No. 11/341,676, filed on Jan. 27, 2006, which claims priority to Korean Patent Application No. 2005-0029903, filed on Apr. 11, 2005 and all the benefits accruing therefrom under 35 U.S.C. §119, and the contents of which in its entirety are herein incorporated by reference.

BACKGROUND OF THE INVENTION

1. Field of the Invention

The present invention relates to a gate drive device for a display device and the display device having the same. More particularly, the present invention relates to a gate drive device improving charging time of sub pixels in a display device, and the display device having the gate drive device.

2. Description of the Related Art

Recently, flat display devices, for example, organic light emitting display ("OLED"), plasma display panel ("PDP"), and liquid crystal display ("LCD") devices have been developing more rapidly than cathode ray tube ("CRT") devices. Among the flat display devices, the widely-used LCD device includes an upper display substrate and a lower display substrate in which electric-field generating electrodes (e.g. a pixel electrode and a common electrode) are formed. Further, the LCD device includes switching elements, display signal lines, and a gate drive portion to generate gate control signals for turning the switching elements on and off. The gate drive portion includes a shift register receptive to outputting gate control signals to gate lines, a level shifter, and an output buffer. The shift register includes multiple stages that are connected one after another to each other. Each stage generates outputs of each gate line in sequence and the generated outputs are applied to the gate lines through the level shifter and the output buffer.

A vertically aligned mode of the LCD device, in which liquid crystal molecules are vertically arranged with respect to the upper and lower display substrates at a no voltage-applied status, has been better received as it has a larger contrast and provides a wider basic viewing angle than other types of LCD devices. Herein, the basic viewing angle indicates the viewing angle having a contrast ratio of 1 to 10 or a threshold angle of brightness inversion among gray levels.

In the vertically aligned mode of the LCD device, there are several methods for performing a wide viewing angle (e.g. methods of forming a partially-removed portion of the electric-field generating electrodes and forming a protrusion on the electric-field generating electrodes). Because of the partially-removed portion and the protrusion control orientation of the liquid crystal molecules, the viewing angle may widen by realigning the liquid crystal molecules in several directions using the partially-removed portion and the protrusion.

However, the vertically aligned mode of the LCD device has a disadvantage of deteriorating a side viewing property compared to a front viewing property (e.g. having a narrower viewing angle). For one example, a patterned vertically aligned mode of the LCD device provided with the partially-removed portion of the electric-field generating electrodes becomes brighter from a front view toward a side view. In other words, the brightness of high gray levels has substantially the same level, so there is a problem of showing bad quality of images.

To solve the problems above, after one pixel is divided into two sub-pixels and the two sub-pixels are capacitively coupled, a method of varying a transmittance of the LCD device, which includes applying a voltage to one sub-pixel, causing voltage-drop by means of capacitive coupling on other sub-pixel, and having different voltages on the sub-pixels, has been suggested. However, when a gate voltage is applied to the two sub-pixels, each stage of the gate drive portion described above generates a gate voltage every one horizontal time (i.e. one horizontal time indicates a time in which one row of pixels is processed). At this time, the two sub-pixels are simultaneously turned on, thus different voltages may not be applied to the two sub-pixels. Although the two sub-pixels of the LCD device, in which a gate drive portion is formed on both end edges of the LCD device, are separately driven, manufacturing costs still rise and the occupied area of the gate drive portion increases, thus the size of the LCD device is increased.

BRIEF SUMMARY OF THE INVENTION

The present invention provides a gate drive portion for improving charging time of sub-pixels within a display device.

The present invention also provides a drive device including the above-described gate drive portion.

The present invention further provides a display device including the above-described gate drive portion.

In exemplary embodiments of the present invention, a gate drive portion for a display device, including multiple pixels each having first and second sub-pixels, includes a first shift register generating a first output signal in response to a first gate clock signal, a second shift register generating a second output signal in response to a second gate clock signal, a level shifter coupled to the first and second shift registers and amplifying the first and second output signals, and an output buffer coupled to the level shifter and generating first and second gate signals.

In other exemplary embodiments of the present invention, a drive device for a display device, including multiple pixels each having first and second sub-pixels, includes a plurality of first gate lines coupled to the first sub-pixel and delivering a first gate signal, a plurality of second gate lines coupled to the second sub-pixel and delivering a second gate signal, and a gate drive portion generating the first and second gate signals and having a first shift register generating the first gate signal, a second shift register generating the second gate signal, a level shifter coupled to the first and second shift registers, respectively, and an output buffer coupled to the level shifter.

In other exemplary embodiments, a display device includes multiple main pixels each including first and second sub-pixels and arranged in a matrix, a plurality of first gate lines coupled to the first sub-pixels and delivering a first gate signal, a plurality of second gate lines coupled to the second sub-pixels and delivering a second gate signal, a gate drive portion generating the first and second gate signals and having a first shift register generating the first gate signal, a second shift register generating the second gate signal, a level shifter coupled to the first and second shift registers, respectively, and an output buffer coupled to the level shifter, and a signal controller applying control signals to the gate drive portion.

In other exemplary embodiments, a display device includes multiple main pixels each including first and second sub-pixels and arranged in a matrix, a plurality of first gate lines coupled to the first sub-pixels and delivering a first gate signal, a plurality of second gate lines coupled to the second sub-pixels and delivering a second gate signal, and a gate drive portion generating the first and second gate signals and including a first shift register generating the first gate signal and a second shift register generating the second gate signal.

BRIEF DESCRIPTION OF THE DRAWINGS

The above and other features and advantage points of the present invention will become more apparent by describing in detailed embodiments thereof with reference to the accompanying drawings, in which.

DETAILED DESCRIPTION OF THE INVENTION

The present invention now will be described more fully hereinafter with reference to the accompanied drawings, in which exemplary embodiments of the invention are shown. The invention may, however, be embodied in many different forms and should not be construed as limited to the embodiments set forth herein.

Figure 1:
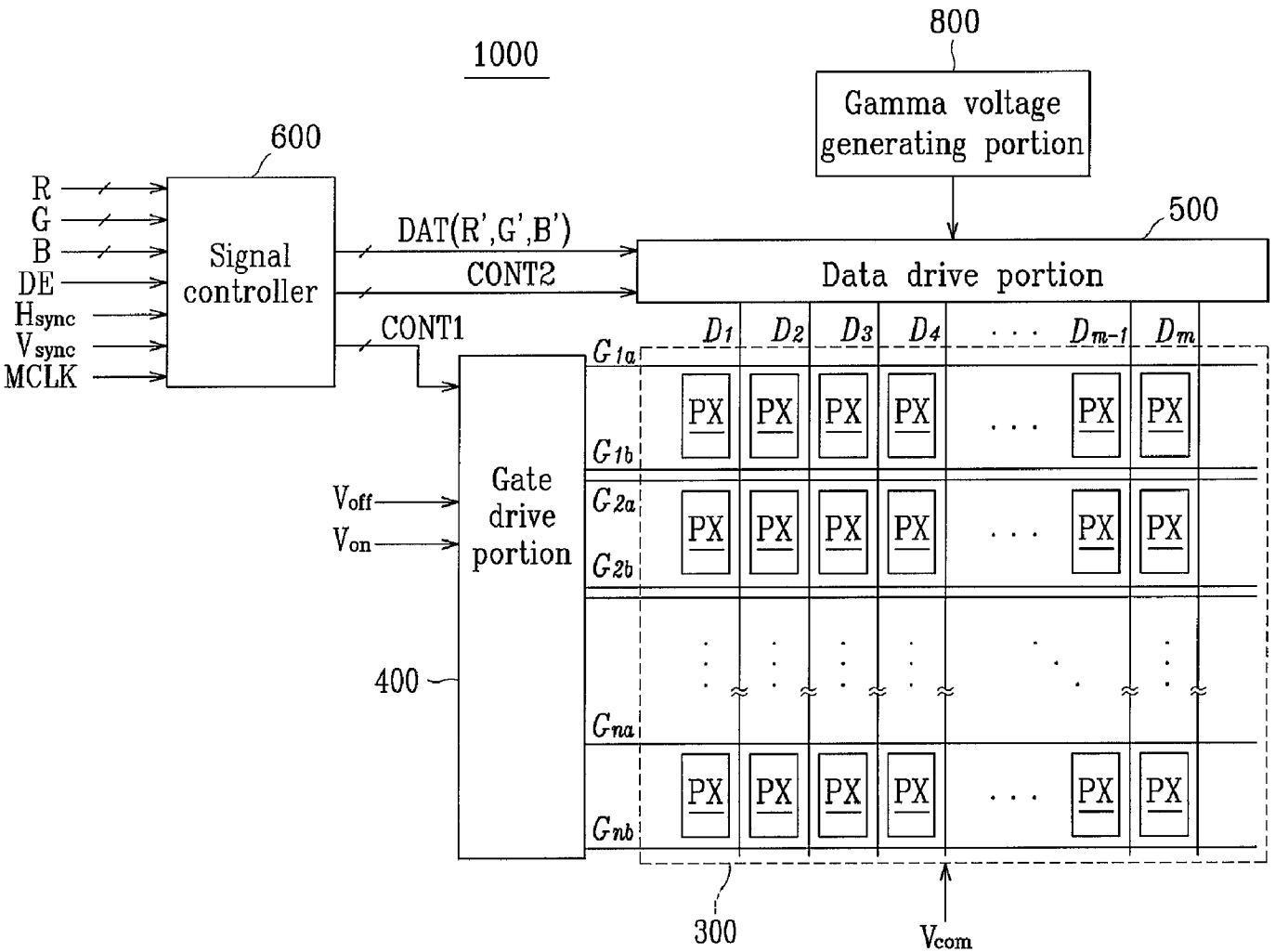
FIG. 1 is a block diagram of exemplary embodiments of a liquid crystal display ("LCD") device in accordance with the present invention.
Figure 2A:
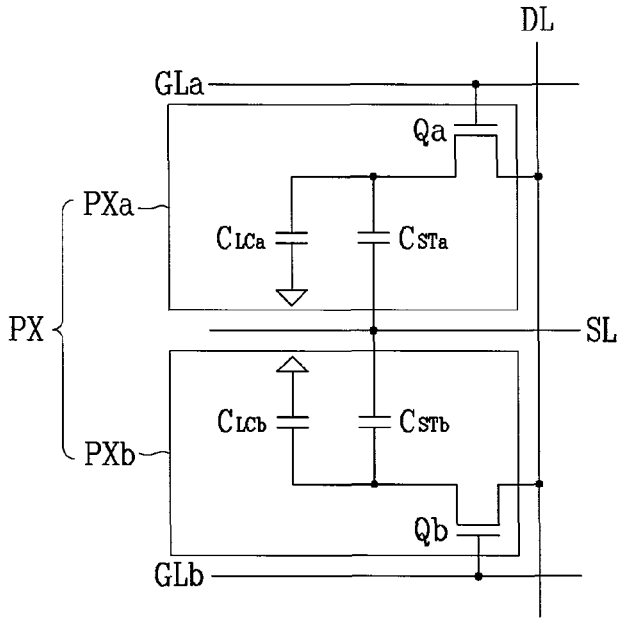
FIGS. 2A and 2B are equivalent circuit views of exemplary embodiments of a pixel in the LCD device in accordance with the present invention.
Figure 2B:
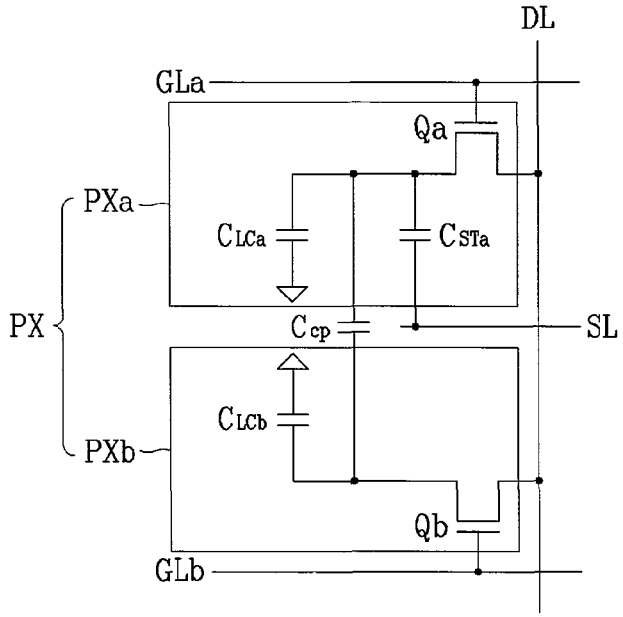
Figure 3:
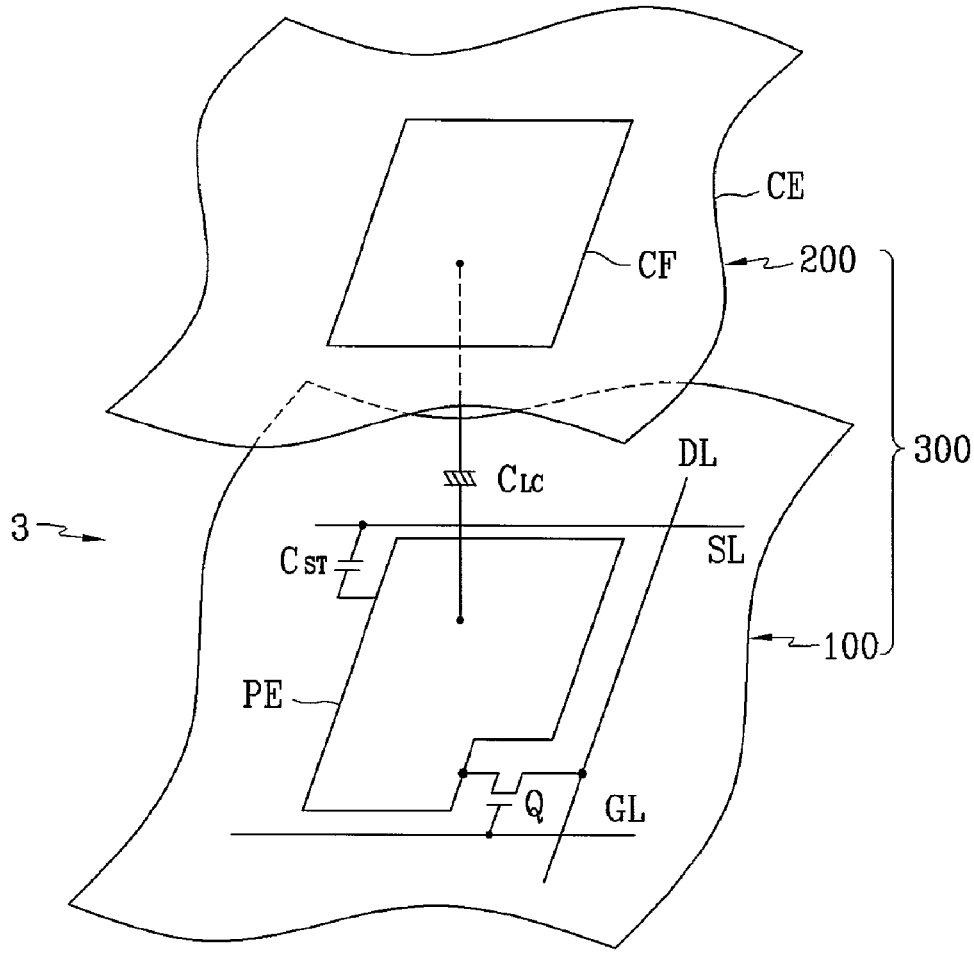
FIG. 3 is an equivalent circuit view of exemplary embodiments of one sub-pixel of the LCD device in accordance with the present invention.

FIG. 1 is a block diagram of exemplary embodiments of a liquid crystal display ("LCD") device in accordance with the present invention, FIGS. 2A and 2B are equivalent circuit views of exemplary embodiments of a pixel in the LCD device in accordance with the present invention, and FIG. 3 is an equivalent circuit view of exemplary embodiments of one sub-pixel of the LCD device in accordance with the present invention.

Turning to FIG. 1, an LCD device 1000 includes a thin film transistor ("TFT") array panel 300, a gate drive portion 400, a data drive portion 500, a signal controller 600, and a gamma voltage generating portion 800. The gate and data drive portions 400 and 500, respectively, are connected to the TFT array panel 300. The gamma voltage generating portion 800 is connected to the data drive portion 500 and may also be connected to the signal controller 600.

The TFT array panel 300 has signal lines including gate lines G1*a*, G1*b*, G2*a*, G2*b*, . . . , Gna and Gnb extending to gate drive portion 400 and data lines D1-Dm extending to data drive portion 500. The TFT array panel 300 also includes pixels PX each connected to the signal lines and arranged in a matrix. The gate lines G1*a*, G1*b*, G2*a*, G2*b*, . . . , Gna, and Gnb are formed parallel with each other in the horizontal (transverse) direction and the data lines D1-Dm are formed parallel with each other intersecting substantially perpendicularly the gate lines G1*a*, G1*b*, G2*a*, G2*b*, . . . , Gna, and Gnb. Each pixel PX includes a switching element Q (shown in FIGS. 2A-3) connected to the gate lines G1*a*, G1*b*, G2*a*, G2*b*, . . . , Gna, and Gnb and the data lines D1-Dm and a pixel circuit (not shown) connected to the switching element Q. The switching element Q may be a TFT. In addition, the switching element Q may be fabricated with amorphous silicon ("a-Si").

Turning to FIGS. 2A and 2B, the LCD device 1000 further includes a storage electrode line SL extending parallel to the gate lines, indicated as GLa, GLb in FIGS. 2A and 2B. As shown in FIG. 2A, each pixel PX includes first and second sub-pixels PXa, PXb and the first and second sub-pixels PXa, PXb each include switching elements Qa, Qb connected to corresponding gate lines GLa, GLb and a corresponding data line DL and liquid crystal capacitors $C_{LCa}$, $C_{LCb}$ connected to the switching elements Qa, Qb, respectively, and storage capacitors $C_{STa}$, $C_{STb}$ connected to the storage electrode line SL. Alternately, the storage capacitors $C_{STa}$, $C_{STb}$ and the storage electrode line SL may be omitted as required.

As shown in FIG. 2B, each pixel PX includes the first and second sub-pixels PXa, PXb and a coupling capacitor $C_{cp}$ disposed between the first and second sub-pixels PXa, PXb. The first and second sub-pixels PXa, PXb each include switching elements Qa, Qb connected to corresponding gate lines GLa, GLb and a corresponding data line DL and liquid crystal capacitors $C_{LCa}$, $C_{LCb}$ connected to the switching elements Qa, Qb, respectively. One of the first and second sub-pixels PXa, PXb includes the storage capacitor $C_{STa}$ disposed between one of the switching elements Qa, Qb and the storage electrode line SL.

Turning to FIG. 3, a switching element Q of the first and second sub-pixels PXa, PXb may be, for example, a TFT formed on a lower display substrate 100. The switching element Q has a control terminal connected to a gate line GL, an input terminal connected to the data line DL, and an output terminal connected to a liquid crystal capacitor $C_{LC}$ and a storage capacitor $C_{ST}$.

The liquid crystal capacitor $C_{LC}$ has two terminals with the sub-pixel electrode PE of the lower display substrate 100 and a common electrode CE of an upper display substrate 200, and a liquid crystal layer 3 disposed between the sub-pixel electrode PE and the common electrode CE operates as a dielectric. The sub-pixel electrode PE is connected to the switching element Q, and the common electrode CE is formed on the entire surface, or substantially the entire surface, of the upper display substrate 200 and receives a common voltage Vcom. Alternatively, the common electrode CE may be formed on the lower display substrate 100 and in this case, at least one of the sub-pixel electrode PE and the common electrode CE may be made from, for example, a line shape or a bar shape.

The storage capacitor $C_{ST}$ operating as a supplement to the liquid crystal capacitor $C_{LC}$ has an insulator disposed between the storage electrode line SL formed on the lower display substrate 100 and the sub-pixel electrode PE. The storage electrode line SL receives a desired voltage such as the common voltage Vcom. Alternatively, the storage capacitor $C_{ST}$ is formed by disposing the sub-pixel electrode PE as an insulator and overlapping a previous gate line.

Meanwhile, each pixel recognizes desired images as sequential and spatial sum of three colors (e.g. red, green, and blue) by displaying one of the three colors, such as primary colors, (i.e. space division) or in turn displaying the three colors as a time varies. FIG. 3 shows that each pixel includes a color filter CF indicating one of the primary colors at an area of the upper display substrate 200 as an example of the space division. Alternatively, the color filter CF may be formed above or under the sub-pixel electrode PE of the lower display substrate 100.

Turning back to FIG. 1, the gate drive portion 400 includes gate drivers (not shown) and the gate drivers are connected to the gate lines G1*a*, G1*b*, G2*a*, G2*b*, . . . , Gna, and Gnb. The gate drive portion 400 applies gate signals to the gate lines G1*a*, G1*b*, G2*a*, G2*b*, . . . , Gna, and Gnb, respectively. Alternately, the gate drive portion 400 may be formed on the lower display substrate 100.

The gamma voltage portion 800 has positive and negative groups of gamma voltages, for example, the positive group of the gamma voltages has higher voltages and the negative group of the gamma voltages has lower voltages than the common voltage Vcom. The number of the positive and negative groups of gamma voltages, respectively, depends on the resolution of the LCD device 1000.

The data drive portion 500 includes data drivers (not shown) and the data drivers are connected to the data lines D1-Dm. The data drive portion 500 applies desired image signals to the data lines D1-Dm by selecting a certain gamma voltage from the gamma voltage portion 800. The gate and data drivers may be formed by attaching a tape carrier package ("TCP") (not shown) to the TFT panel assembly 300, and may be mounted on the lower display substrate 100, for example, chip on glass ("COG").

The signal controller 600 generates control and timing signals and controls the gate drive portion 400 and the data drive portion 500.

Operation of the LCD device 1000 will now be described in further detail with reference to FIGS. 1 to 3.

Turning to FIG. 1, the signal controller 600 receives input control signals Vsync, Hsync, Mclk, DE from an external graphic controller (not shown) and input image signals R, G, B and generates image signals R', G', B', gate control signals CONT1, and data control signals CONT2 with respect to the input control signals Vsync, Hsync, Mclk, DE and the input image signals R, G, B. Further, the signal controller 600 sends the gate control signals CONT1 to the gate drive portion 400 and the data control signals CONT2 to the data drive portion 500. The gate control signals CONT1 include a vertical synchronization start signal STV indicating start of one frame, a gate clock signal CPV controlling an output timing of the gate on signal, an output enable signal OE indicating an ending time of one horizontal line, etc. The data control signals CONT2 include a horizontal synchronization start signal STH indicating start of one horizontal line, TP or LOAD instructing an output of data voltages, RVS or POL instructing polarity reverse of data voltages with respect to the common voltage Vcom, etc.

Turning to FIGS. 1-3, the data drive portion 500 receives the image signals R', G', B' from the signal controller 600 and outputs the data voltages by selecting gamma voltages corresponding to the image signals R', G', B' according to the data control signals CONT2. The gate drive portion 400 applies the gate on signal according to the gate control signals CONT1 to the gate lines G1*a*, G1*b*, G2*a*, G2*b*, . . . , Gna, and Gnb and turns on the switching elements Qa, Qb connected to the gate lines G1*a*, G1*b*, G2*a*, G2*b*, . . . , Gna, and Gnb. Accordingly, the data voltages applied to the data lines D1-Dm are applied to corresponding sub-pixels PXa, PXb through switching elements Qa, Qb turned on.

A difference between the data voltages applied to the first and second sub-pixels PXa, PXb and the common voltage Vcom indicates a charging voltage (i.e. a pixel voltage) of the liquid crystal capacitor $C_{LCa}$, $C_{LCa}$. An alignment of liquid crystal molecules in the liquid crystal layer 3 vary according to a size of the pixel voltages, and accordingly, polarization of light passing through the liquid crystal layer 3 varies. Such variation of the polarization represents variation of transmittance of light by means of one or more polarizers (not shown) attached to the lower and upper display substrates 100, 200. For example, a first polarized film and a second polarized film may be disposed on the lower and upper display substrates 100, 200, respectively. The first and second polarized films may adjust a transmission direction of light externally provided into the lower display substrate 100 and the upper display substrate 200, respectively, in accordance with an aligned direction of the liquid crystal layer 3. The first and second polarized films may have first and second polarized axes thereof substantially perpendicular to each other, respectively. Other arrangements of polarizers are also within the scope of these embodiments.

An operation of overlapping a period of time for applying the gate on signal to two adjacent gate lines will now be described with reference to FIGS. 4, 5A, and 5B.

Figure 4:
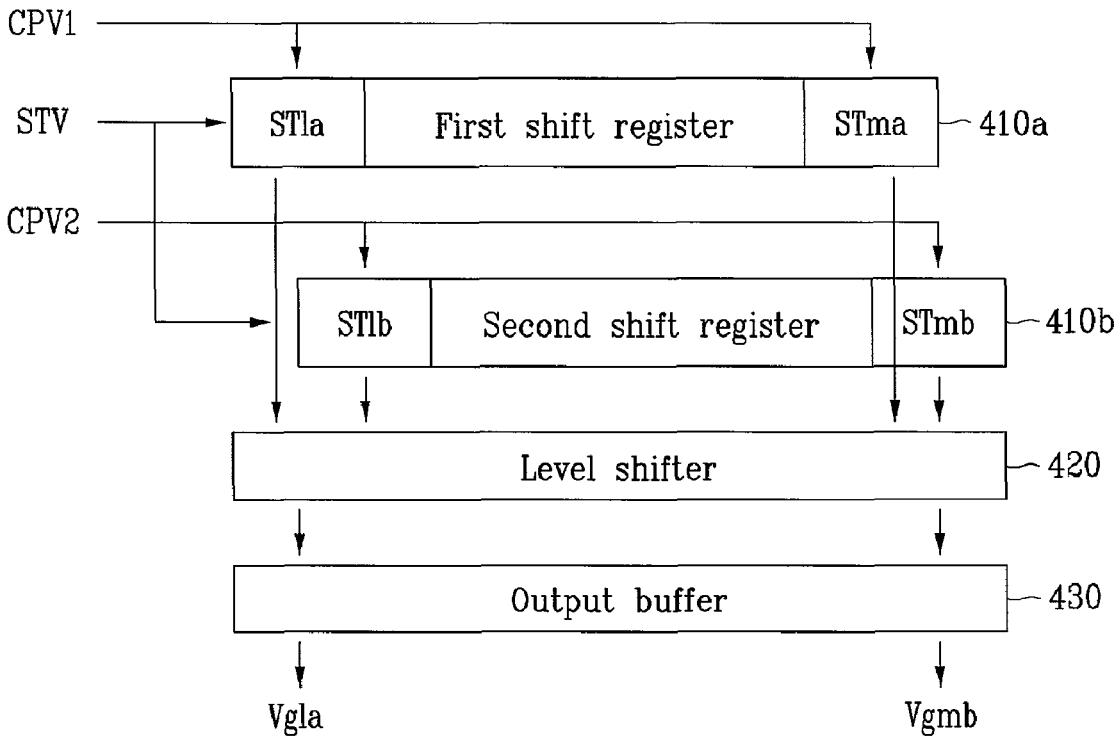
FIG. 4 is a block diagram of exemplary embodiments of a gate drive portion in accordance with the present invention.
Figure 5A:
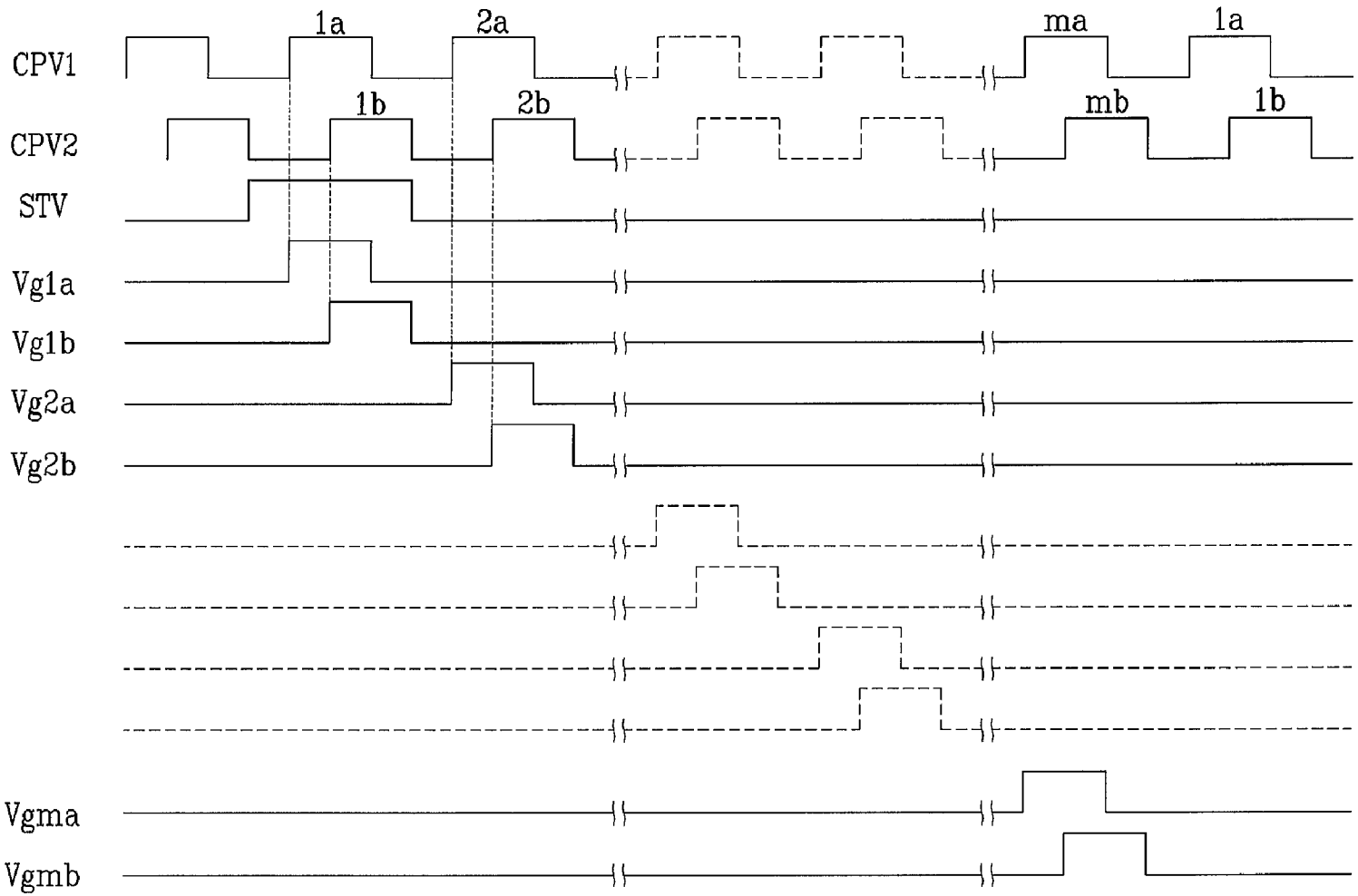
FIGS. 5A and 5B are signal waveforms of the exemplary gate drive portion in FIG. 4.
Figure 5B:
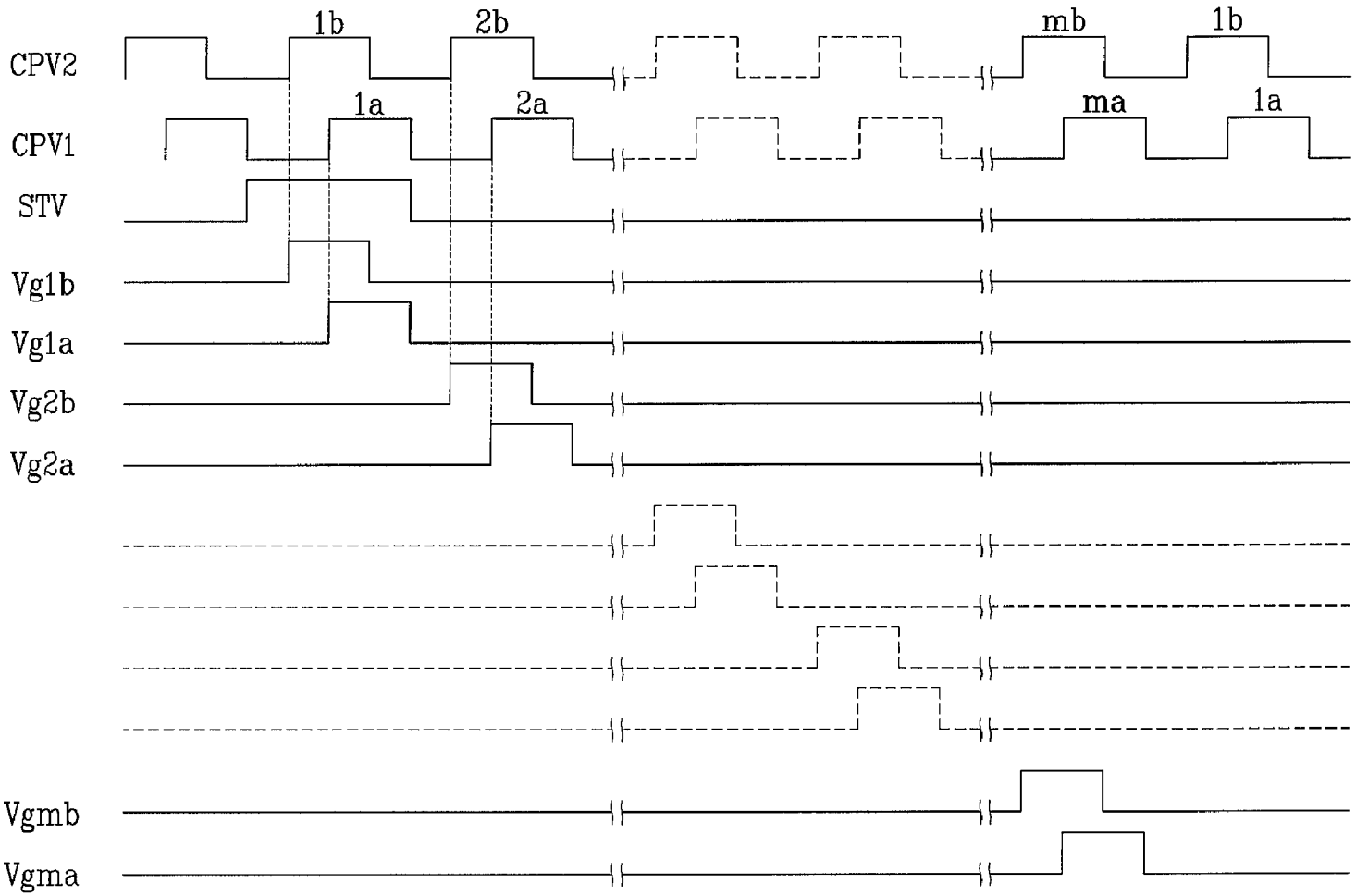

FIG. 4 is a block diagram of exemplary embodiments of a gate drive portion 400 in accordance with the present invention and FIGS. 5A and 5B are signal waveforms of the exemplary gate drive portion 400 in FIG. 4.

Turning to FIG. 4, the gate drive portion 400 includes first and second shift registers 410*a*, 410*b*, a level shifter 420 connected to the first and second shift registers 410*a*, 410*b*, and an output buffer 430. The first and second shift registers 410*a*, 410*b* receive the vertical synchronization start signal STV and first and second gate clock signals CPV1, CPV2. The vertical synchronization start signal STV and the first and second gate clock signals CPV1, CPV2 are part of the gate control signals CONT1 sent from the signal controller 600 to the gate drive portion 400. Each of the first and second shift registers 410*a*, 410*b* include multiple stages ST1*a*, . . . , STma and ST1*b*, . . . , STmb, respectively.

The level shifter 420 amplifies output of the first and second shift registers 410*a*, 410*b* to an amplitude suitable for operating the switching elements Q of the pixel PX and sends the first amplified output to the output buffer 430. The output buffer 430 amplifies the first amplified output by a reduced level considering reduction of the gate voltage due to a signal delay and sends the second amplified output. Assuming that the gate line GLa refers to odd-numbered gate lines G1*a*, G2*a*, . . . , Gna and the gate line GLb refers to even-numbered gate lines G1*b*, G2*b*, . . . , Gnb (referring to FIGS. 2A and 2B), the first shift register 410*a* generates a gate signal for operating the switching element Qa connected to the odd-numbered gate lines G1*a*, G2*a*, . . . , Gna and the second shift register 410*b* generates a gate signal for operating the switching element Qb connected to the even-numbered gate lines G1*b*, G2*b*, . . . , Gnb.

Turning to FIGS. 5A and 5B, the first and second gate clock signals CPV1, CPV2 have one horizontal period, 1H, and a duty ratio of 50%, where the duty ratio is the ratio of the pulse duration to the pulse period. With a duty ratio of 50%, or approximately 50%, the first and second gate clock signals CPV1, CPV2 have a pulse duration that is half of the pulse period. The first gate clock signal CPV1 in FIG. 5A advances the second gate clock signal CPV2 by ¼H, or approximately ¼H, and the second gate clock signal CPV2 in FIG. 5B advances the first gate clock signal CPV1 by ¼H, or approximately ¼H. Herein, gate voltages generated by the first and second shift registers 410*a*, 410*b*, the level shifter 420, and the output buffer 430 indicate voltages generated at the first and second shift registers 410*a*, 410*b* and refer to 'Vg'. Vga indicates gate voltages applied to the odd-numbered gate lines G1*a*, G2*a*, . . . , Gna and Vgb indicates gate voltages applied to the even-numbered gate lines G1*b*, G2*b*, . . . , Gnb.

When the vertical synchronization start signal STV is applied to the first and second shift registers 410*a*, 410*b*, first stages ST1*a*, ST1*b* (shown in FIG. 4) of the first and second shift registers 410*a*, 410*b* synchronize with rising edges of the first and second gate clock signals CPV1, CPV2 during a high level of the vertical synchronization start signal STV and output gate signals Vg1*a*, Vg1*b*, respectively.

Each of the remaining stages (not shown) of the first shift register 410*a* receives an output of a previous stage as a carry signal (instead of the vertical synchronization start signals STV), synchronizes with the first gate clock signal CPV1, and sends gate signals Vg2*a*, . . . , Vgma to the odd-numbered gate lines G2*a*, . . . , Gna. The second shift register 410*b* has the same configuration as the first shift register 410*a*. In other words, each of the remaining stages of the second shift register 410*b* sends gate signals Vg2*b*, . . . , Vgmb to the even-numbered gate lines G1*b*, G2*b*, . . . , Gnb by receiving an output of a previous stage as a carry signal and synchronizing with the second gate clock signal CPV2.

Turning to FIGS. 2A and 5A, since the first gate clock signal CPV1 advances the second gate clock signal CPV2 by ¼H, the liquid crystal capacitor $C_{LCa}$ of the first sub-pixel PXa connected to the odd-numbered gate line GLa is first charged and then the liquid crystal capacitor $C_{LCb}$ of the second sub-pixel PXb connected to the even-numbered gate line GLb is charged. Alternately, as shown in FIGS. 2B and 5B, the liquid crystal capacitor $C_{LCb}$ of the second sub-pixel PXb connected to the even-numbered gate line GLb is first charged and then the liquid crystal capacitor $C_{LCa}$ of the first sub-pixel PXa connected to the odd-numbered gate line GLa is charged.

Turning to FIGS. 5A and 5B, each of the odd-numbered gate signals Vg1*a*, Vg2*a*, . . . , Vgma overlaps the even-numbered gate signals Vg1*b*, Vg2*b*, . . . , Vgmb, respectively, but the gate signals Vg1*a*, Vg1*b* do not overlap the gate signals Vg2*a*, Vg2*b*. In other words, the gate signal Vg1*b* does not overlap the gate signal Vg2*a* as shown in FIG. 5A and the gate signal Vg1*a* does not overlap the gate signal Vg2*b* as shown in FIG. 5B. Accordingly, the first and second sub-pixels PXa, PXb each connected to the odd-numbered and even-numbered gate lines GLa, GLb receive data voltages during 1H, respectively, and thus the liquid crystal capacitors $C_{LCa}$, $C_{LCb}$ of the first and second sub-pixels PXa, PXb are charged sufficiently.

Meanwhile, the second gate clock signal CPV2 has a duty ratio of 50%, for example, but it is not limited thereto. In other words, a higher charging rate of the first sub-pixel PXa may be obtained with a larger duty ratio, such as, but not limited to a duty ratio of 75%, of the second gate clock signal CPV2.

Figure 6:
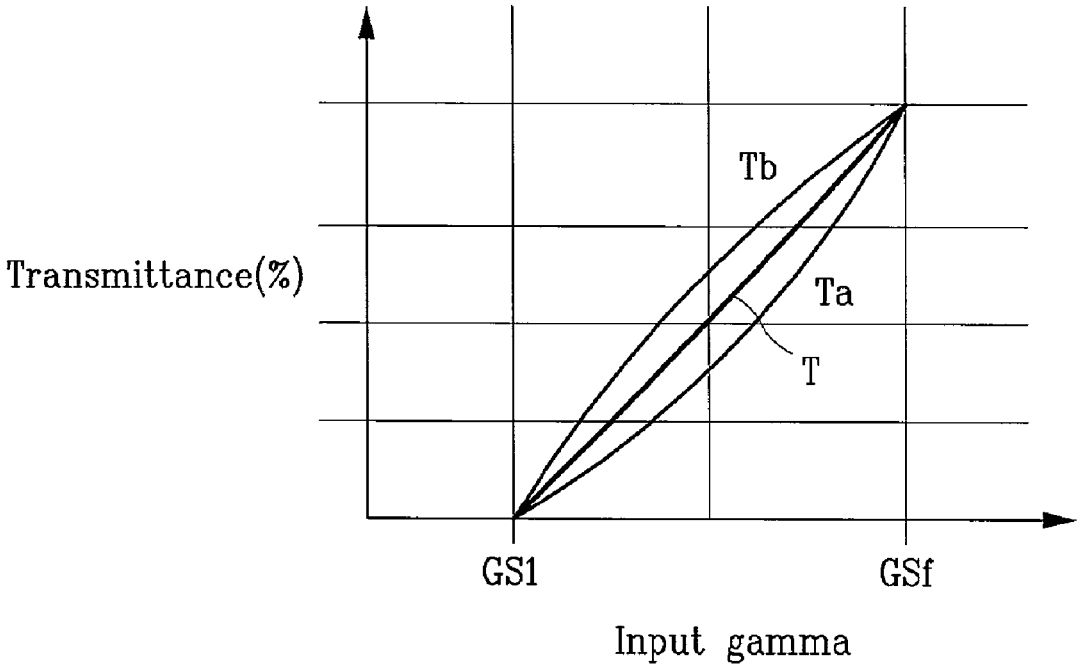
FIG. 6 is a graphical view showing a gamma curve of exemplary embodiments of the LCD device in accordance with the present invention.

Turning to FIG. 6, FIG. 6 shows gamma curves which represent a transmittance dependent on an input gamma, where GS1 is the lowest input gamma and GSf is the highest input gamma. Positive and negative groups of gamma voltages (referring to FIG. 1) have first and second gamma curves Ta, Tb, respectively. The first and second sub-pixels PXa, PXb of one pixel PX receive a characteristic of the third gamma curve T which sums the first and second gamma curves Ta, Tb. Regarding a reference gamma curve which defines better reference gammas, the third gamma curve T at a front view meets the reference gamma curve at a front view and the third gamma curve T at either side view meets closer to the reference gamma curve at either side view.

Several types of data voltages in the LCD device 1000 having the gate drive portion 400 will now be described with reference to FIGS. 7A to 8B.

Figure 7A:
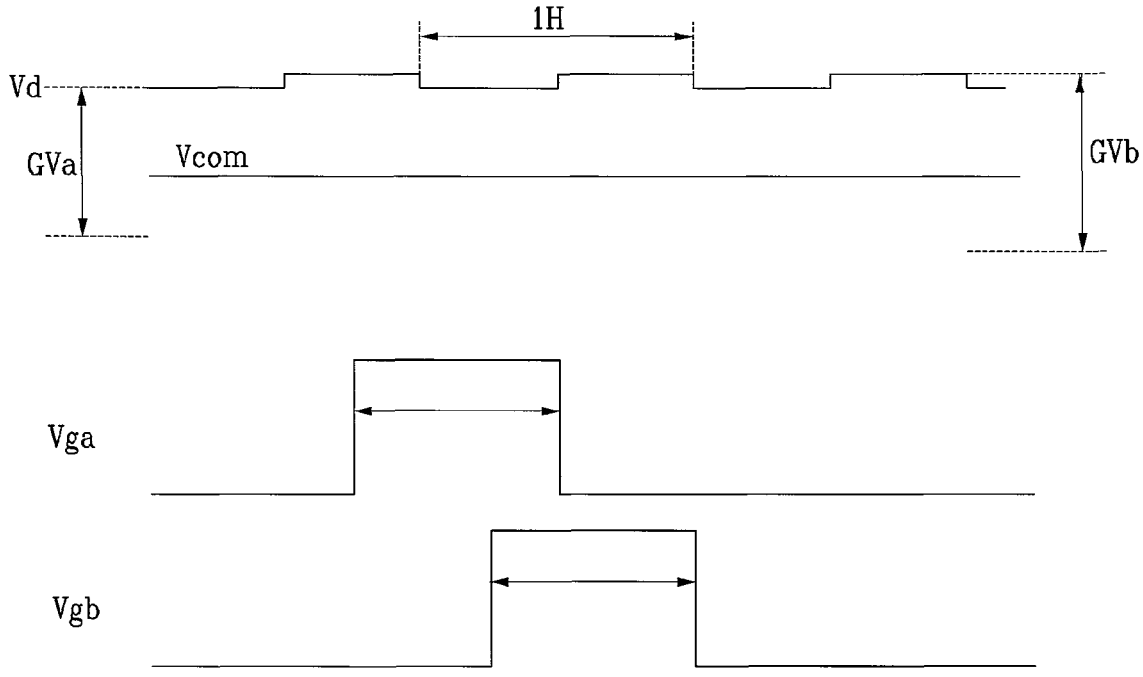
FIGS. 7A to 8B are graphical views showing signal waveforms of exemplary embodiments of the LCD device in accordance with the present invention.
Figure 7B:
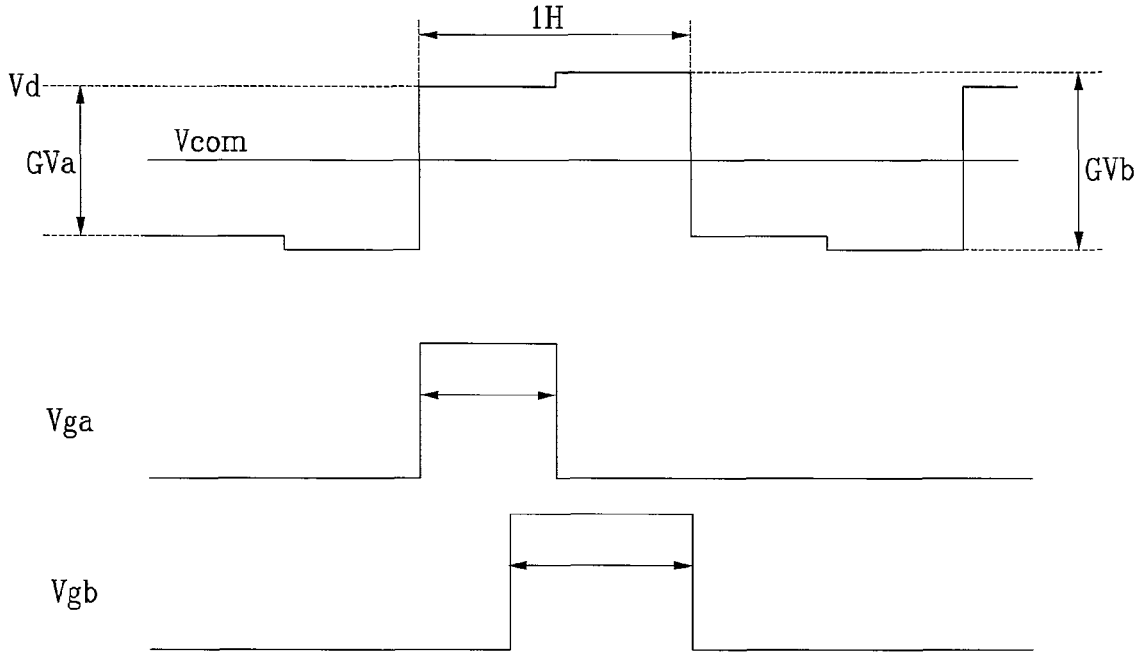
Figure 8A:
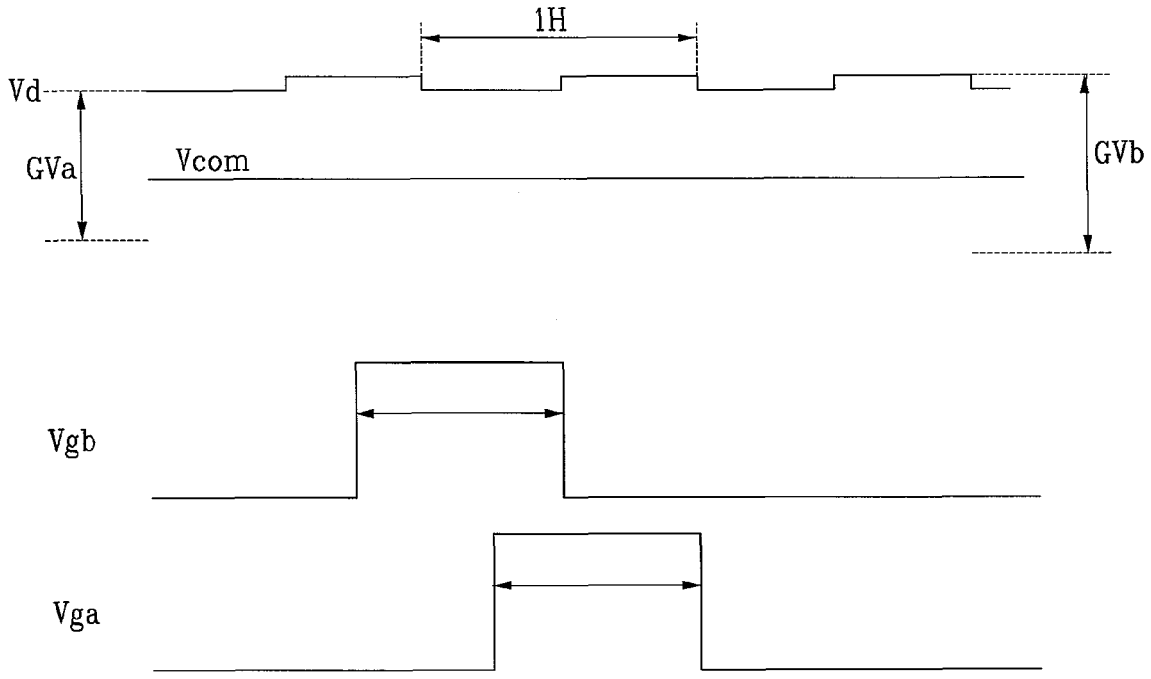
Figure 8B:
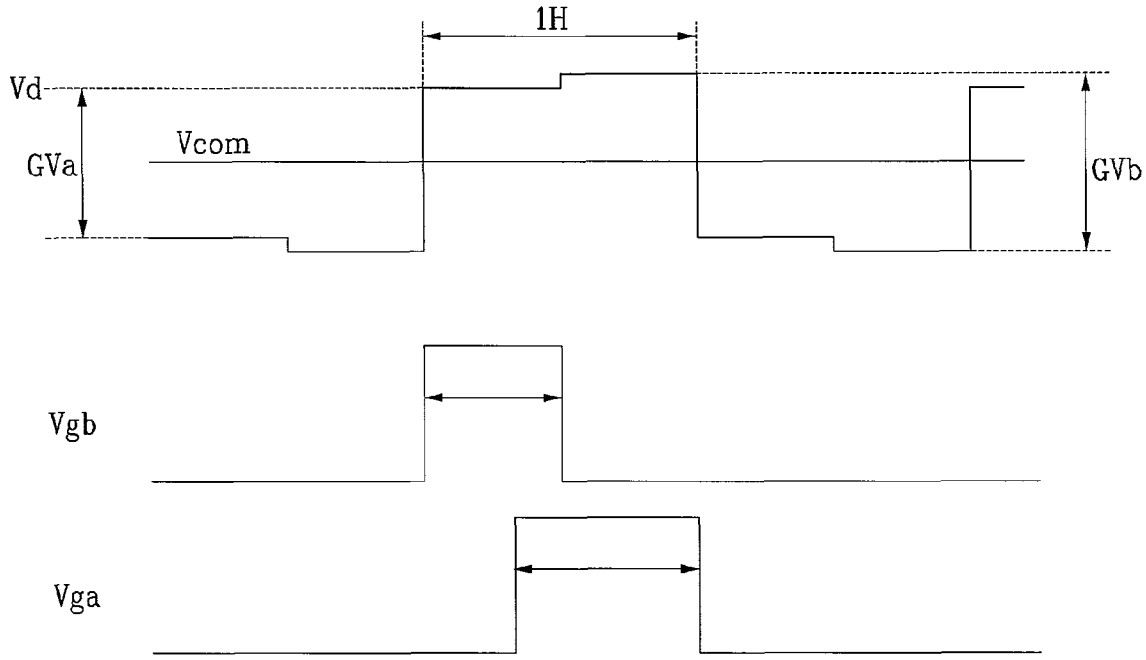

FIGS. 7A to 8B show graphical views showing signal waveforms of exemplary embodiments of the LCD device in accordance with the present invention, wherein Vd is a data voltage flowing on one data line. FIGS. 7A and 7B show data voltages of the case where the first gate clock signal CPV1 advances the second gate clock signal CPV2 described with respect to FIG. 5A, and FIGS. 8A and 8B show data voltages of the case where the second gate clock signal CPV2 advances the first gate clock signal CPV1 described with respect to FIG. 5B.

In a dot-inversion driving of the LCD device 1000, since polarities of adjacent pixels PX are different, receiving data voltages of the adjacent pixels PX does not help reduce a charging time. Accordingly, as shown in FIGS. 7A and 8A, charging times of adjacent pixels PX do not overlap and charging times of the sub-pixels PXa, PXb do overlap. Since the charging time of the later charged sub-pixel, PXa or PXb, of the first and second sub-pixels PXa, PXb reduces, as shown in FIGS. 7A and 8A, a data voltage GVb applied to the later charged sub-pixel, PXa or PXb, makes larger than a data voltage GVa applied to the first charged sub-pixel, PXb or PXa.

Meanwhile, in a column inversion driving of the LCD device, since polarities of the adjacent pixels in the vertical direction are the same, the pre-charging may be performed by applying data voltages of the adjacent pixels. Accordingly, as shown in FIGS. 7B and 8B, the charging times of all the sub-pixels may overlap during more than a desired time.

Further, the gate drive portion 400 (referring back to FIG. 1) may not make the first and second gate clock signals CPV1, CPV2 overlap and this may be applied to a configuration of when one pixel has one switching element. Alternately, unlike the gate drive portion 400, a gate drive portion may apply the vertical synchronization start signal STV to last stages of the first and second shift registers, respectively, and in this case, the gate signals may be in sequence generated from left to right. In other words, when the vertical synchronization start signal STV is applied to first stages of the first and second shift registers, respectively, the gate signals (e.g. Vg1*a*, Vg2*a*, . . . , Vgma) are in sequence generated from left to right. Alternately, when the vertical synchronization start signal STV is applied to the last stages of the first and second shift registers, respectively, the gate signals (e.g. Vgma, . . . , Vg2*a*, Vg1*a*) are in sequence generated from right to left.

According to embodiments of the present invention, the charging time of the sub-pixels may be improved by separately driving the odd-numbered and even-numbered sub-pixels and the visibility of the LCD device may also be improved. Additionally, a size of the display substrate may be reduced by driving the odd-numbered and even-numbered gate lines by means of the gate drive portion formed on only one edge of the lower display substrate.

Having described the embodiments of the present invention and its advantages, it should be noted that various changes, substitutions and alterations can be made herein without departing from the spirit and scope of the invention as defined by the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A gate driver for a display device including multiple pixels each having first and second sub-pixels, the gate driver comprising:

a first shift register generating a first output signal in response to a first gate clock signal;

a second shift register generating a second output signal in response to a second gate clock signal;

a level shifter coupled to the first and second shift registers and amplifying the first and second output signals; and an output buffer coupled to the level shifter and generating first and second gate signals, wherein the first gate clock signal partially overlaps the second gate clock signal, and wherein charging times of adjacent pixels do not overlap and charging times of the first and second sub-pixels within each pixel do overlap.

2. The gate driver of claim 1, wherein a width of the first gate clock signal during a high level of the first gate clock signal is different from a width of the second gate clock signal during a high level of the second gate clock signal.

3. The gate driver of claim 1, wherein the first gate signal is generated in synchronization with the first gate clock signal, and the second gate signal is generated in synchronization with the second gate clock signal.

4. The gate driver of claim 1, wherein the first gate clock signal advances the second gate clock signal by ¼ horizontal period.

5. The gate driver of claim 1, wherein the second gate clock signal advances the first gate clock signal by ¼ horizontal period.

6. The gate driver of claim 1, wherein the first and second shift registers include multiple stages connected successively to each other, and at least one of first stage and last stage within each of the first and second shift registers receives a vertical synchronization start signal.

7. A gate driver for a display device including multiple pixels each having first and second sub-pixels, the gate driver comprising:

a first shift register generating a first output signal in response to a first gate clock signal;

a second shift register generating a second output signal in response to a second gate clock signal;

a level shifter coupled to the first and second shift registers and amplifying the first and second output signals; and an output buffer coupled to the level shifter and generating first and second gate signals, wherein the first gate signal is generated in synchronization with the first gate clock signal, and the second gate signal is generated in synchronization with the second gate clock signal, and wherein charging times of adjacent pixels do not overlap and charging times of the first and second sub pixels within each pixel do overlap.

8. The gate driver of claim 7, wherein a width of the first gate clock signal during a high level of the first gate clock signal is different from a width of the second gate clock signal during a high level of the second gate clock signal.

9. The gate driver of claim 7, wherein the first gate clock signal partially overlaps the second gate clock signal.

10. The gate driver of claim 7, wherein the first gate clock signal advances the second gate clock signal by ¼ horizontal period.

11. The gate driver of claim 7, wherein the second gate clock signal advances the first gate clock signal by ¼ horizontal period.

12. The gate driver of claim 7, wherein the first and second shift registers include multiple stages connected successively to each other, and at least one of first stage and last stage within each of the first and second shift registers receives a vertical synchronization start signal.

13. A display device, comprising:

multiple main pixels each including first and second sub-pixels and arranged in a matrix;

a plurality of first gate lines coupled to the first sub-pixels and delivering a first gate signal;

a plurality of second gate lines coupled to the second sub-pixels and delivering a second gate signal;

a gate driver generating the first and second gate signals and comprising:

a first shift register generating the first gate signal in response to a first gate clock signal;

a second shift register generating the second gate signal in response to a second gate clock signal;

a level shifter coupled to the first and second shift registers, respectively; and an output buffer coupled to the level shifter, and a signal controller applying control signals to the gate driver, wherein charging times of adjacent main pixels do not overlap and charging times of the first and second sub-pixels within each main pixel do overlap.

14. The display device of claim 13, further comprising first and second liquid crystal capacitors coupled with each of the first and second sub pixels, respectively, wherein the first and second liquid crystal capacitors are not simultaneously charged.

15. The display device of claim 14, wherein a charging time of a later charged sub pixel is reduced as compared to a charging time of a prior charged sub pixel.

16. The display device of claim 13, wherein the first and second sub pixels receive different data voltages.

17. The display device of claim 13, wherein a width of the first gate clock signal during a high level of the first gate clock signal is different from a width of the second gate clock signal during a high level of the second gate clock signal.

18. The display device of claim 13, wherein the first gate signal synchronizes with the first gate clock signal and the second gate signal synchronizes with the second gate clock signal.

19. The display device of claim 13, wherein the first gate clock signal partially overlaps the second gate clock signal.

20. The display device of claim 19, wherein the first gate clock signal advances the second gate clock signal by ¼ horizontal period.

21. The display device of claim 19, wherein the second gate clock signal advances the first gate clock signal by ¼ horizontal period.

22. The display device of claim 13, wherein the first and second shift registers include multiple stages connected successively to each other, and at least one of first stage and last stage within each of the first and second shift registers receives a vertical synchronization start signal.

23. The display device of claim 13, wherein the plurality of first and second gate lines extend from a first side of the display device to a second side of the display device, the gate driver positioned only on the first side of the display device.

* * * * *